US005345991A

United States Patent [19]

Huber et al.

[11] Patent Number: 5,345,991

[45] Date of Patent: Sep. 13, 1994

[54] ROLLING GATE

[75] Inventors: Johann Huber, Reutlingen; Dieter Lutze, Kirchentellinsfurt, both of Fed. Rep. of Germany

[73] Assignee: Reiff GmbH, Reutlingen, Fed. Rep. of Germany

[21] Appl. No.: 17,620

[22] Filed: Feb. 12, 1993

[30] Foreign Application Priority Data

Feb. 13, 1992 [DE] Fed. Rep. of Germany ..... 4204267

[51] Int. Cl.[5] ..... E06B 9/08

[52] U.S. Cl. ..... 160/122; 160/241; 160/311

[58] Field of Search ..... 160/120, 122, 25, 26, 160/31, 32, 133, 310, 311, 312, 84.1 G, 66, 68, 71, 80, 22, 241

[56] References Cited

U.S. PATENT DOCUMENTS

| | | | |
|---|---|---|---|
| 3,090,425 | 5/1963 | Carlo | 160/25 |
| 3,090,426 | 5/1963 | Carlo | 160/25 |
| 3,386,489 | 6/1968 | Denton et al. | 160/25 |
| 3,500,894 | 3/1970 | Pofferi | 160/22 |
| 3,504,728 | 4/1970 | Wardlaw | 160/26 |
| 4,096,902 | 6/1978 | Junod . | |
| 4,286,343 | 9/1981 | Lampka | 160/122 X |
| 4,821,786 | 4/1989 | Johnston | 160/26 X |
| 4,836,263 | 6/1989 | Ament | 160/68 |
| 4,874,196 | 10/1989 | Goldstein et al. | 160/71 X |

FOREIGN PATENT DOCUMENTS 9103559 8/1991 Fed. Rep. of Germany .

*Primary Examiner*—David M. Purol
*Attorney, Agent, or Firm*—Michael J. Striker

[57] ABSTRACT

A rolling gate of the invention has two gate parts movable toward or away from each other from opposite sides of a gate opening; carriage tracks mounted above the gate opening; a running carriage connected to each gate part and movably mounted on carriage tracks above the gate opening to carry each gate part as the gate parts are moved toward or away from each other; a guide member provided on each gate part extending along a front edge of each gate part; an L-shaped force transmitting element for each gate part, a first end of which is pivotally connected to and slidable along the guide member of that gate part and a second end of which is pivotally connected to a stationary member, advantageously the frame of the gate, and a linear drive for each gate part, which can be a hydraulic or pneumatic drive, including an extendible driven member connected to one of the force transmitting elements to pivot the force transmitting element and thus move the movable gate parts to or from each other to open and close the rolling gate and to provide a controlled clamping force between the closed gate parts.

15 Claims, 5 Drawing Sheets

ROLLING GATE

BACKGROUND OF THE INVENTION

The present invention relates to a gate and, more particularly, to a horizontal rolling gate.

A horizontal rolling gate is known comprising one horizontal gate part or two horizontal gate parts movable to and from each other to open and close a gate opening, winding rollers located laterally relative to the gate opening for each of the gate parts, running carriages movable along carriage tracks above the gate opening and longitudinally extending guide members located on the front edges of the gate parts.

A rolling gate is already known whose gate halves are driven on running carriages movably supported on carriage tracks above the gate opening. The front edges of the gate halves have other guide members attached thereto and are suspended from the running carriages above the gate opening. To avoid a twisting or deformation of the gate halves in closing and opening the gates either a very slow motion of the gate and/or additional guide mechanisms on the ground are necessary. These ground-based guide elements have the disadvantage that they hinder passage through the open gate and can be clogged with dirt.

SUMMARY OF THE INVENTION

It is an object of the present invention to provide a rolling gate of the above-described type whose drive mechanism distributes the closing forces acting on the gate parts so that a rapid gate motion is possible without danger of twisting or distorting the guide members at the front edge of the gate part, while avoiding installation of additional guide means on the ground.

This object and others which will be made more apparent hereinafter are attained in a rolling gate having a gate opening and two rolling gate parts movable to and from each other from opposite sides of the gate opening; carriage tracks above the gate opening; a running carriage connected to each of the gate parts and movably mounted on the carriage tracks above the gate opening.

According to the invention, the rolling gate also has guide members mounted on a front edge of each of the gate parts; an L-shaped force transmitting element for each of the gate parts pivotally connected at a first end thereof at the front edge of the gate part and at a second end thereof to a stationary member, such as a frame of the gate, and linear drive means associated with each of the gate parts having an extensible driven member connected pivotally to respective force transmitting elements of the gate part so as to drive the movable gate parts to and from each other in response to the drive means. No additional guide means on the ground are necessary.

The L-shaped force transmitting element provides a lever arm for the action of the linear drive means. Furthermore it transmits the force of the drive means directly to the guide means on the front edge of the gate part. Because of this device and also the passive guiding of the guide member carried by the running carriage at its upper end a distortion or tilting of the bendable gate part is effectively avoided. It is thus possible to provide for a rapid gate closing motion. It is particularly advantageous when one end of the force transmitting element is pivotally connected in the lower half of the guide member on the front edge of the gate part, i.e. the action of the force occurs on the lower portion of the gate part, while a reliable guiding occurs in the upper half of the guide member because of the suspension of the gate part from the running carriage above the gate opening.

The other end of the force transmitting element can be connected pivotally either above or to the side of the gate opening.

In a preferred embodiment of the rolling gate according to the invention the L-shaped force transmitting element comprises a first leg member and a second leg member connected to the first leg member at an angle relative to the first leg member. A free end of the second leg member is pivotally connected above the gate opening. A free end of the first leg member can be pivotally connected to a slidable connector, which is guided in the guide member on the front edge of the gate part with which it is associated. Because of this arrangement the horizontal force on the front edge of the gate part is reduced as the gate part is moved into the closed position. Because of that additional safety mechanisms, which keep the closing forge being applied to the gate parts below a certain allowed maximum value, can be omitted with suitably dimensioned gate parts and a sufficient closing force for rapid gate part motion is guaranteed.

The multiple attachment of the force transmitting element above the gate opening, to the guide members on the front edge of the gate part and to the linear drive means provides the further advantage that on closing of the gate part reinforced gate panels are formed which can take a high wind force without additional supports or ground guide means and without impairing its operation.

In a preferred embodiment the linear drive means can be pivotally mounted laterally to the gate opening so that, when the gate parts are in an open position, the linear drive means is vertically oriented. Thus very little space is required to accommodate the drive means mounted in this way and it can be accommodated on the frame of the gate with no difficulties.

To avoid damage to the drive and guide mechanism of the gate and to avoid contamination of it each gate part can have a mechanism or means for at least partially covering the force transmitting element and the linear drive means which is mounted in the inner side of the gate. The mechanism can provide a panel or planar member which is movable jointly with the gate parts and parallel to them. The gate parts thus can include at least one winding roller on each side of the gate opening and at least one flexible planar member wound and unwound from each of the at least one winding rollers during opening and closing of the gate parts. The flexible planar member forms part of the means for at least partially covering the force transmitting elements and the drive means.

The carriage tracks above the gate opening can be pivotally supported on both sides of the gate parts so as to be pivotable over a predetermined pivot angle about their joint longitudinal axis to absorb impacts against the closed gate. Because of that, a buckling of the gate and its force transmitting elements, for example, by being accidently rammed by a motor vehicle can be largely avoided and thus the life of the gate can be considerably increased.

It is also possible to provide a gate which has only a single gate part movable to open and close a gate opening with a single force transmitting element, carriage tracks above the gate opening with a running carriage from which the upper end of a guide member attached to the front edge of the gate part is connected and linear drive means connected pivotally with a force transmitting element pivotally connected to the guide member. The linear drive means can of course be a piston-cylinder device, e.g. a hydraulic cylinder.

BRIEF DESCRIPTION OF THE DRAWING

The objects, features and advantages of the present invention will now be illustrated in more detail by the following detailed description, reference being made to the accompanying drawing in which.

DESCRIPTION OF THE PREFERRED EMBODIMENTS

Figure 1:
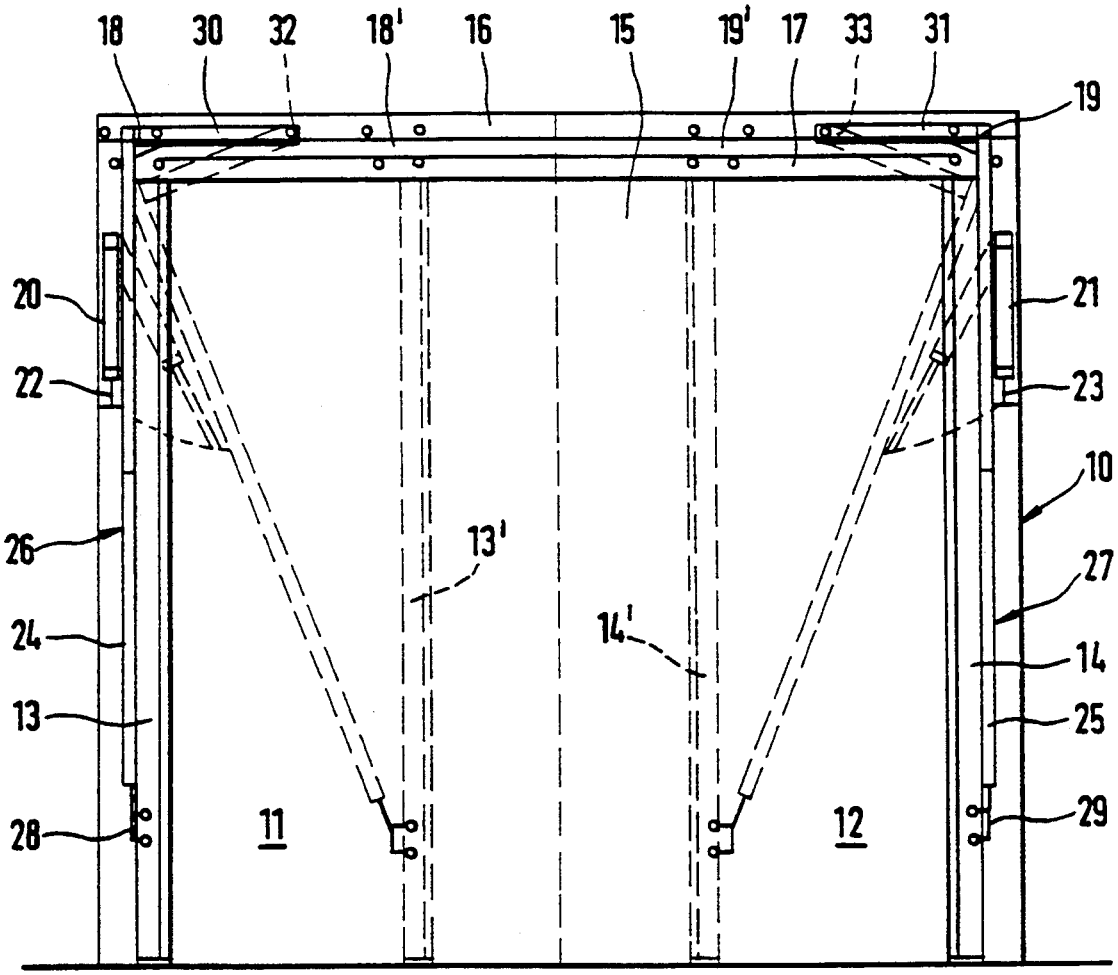
FIG. 1 is a front plan view of a gate with two gate parts according to the invention in an open and a half-open position, the half-open position being shown with dashed lines.

A preferred embodiment of the rolling gate according to the invention comprises a frame 10 bounding a gate opening 15, two rolling gate parts 11 and 12 mounted movably in the frame 10 and longitudinally extending guide members 13 and 14 on the front edges of the gate parts 11 and 12 respectively. Carriage tracks 16 and 17 for running carriages 18 and 19, to which respective guide members 13,14 of both gate parts 11 and 12 are attached, are mounted above the gate opening 15. The drive for closing the gate comprises two piston-cylinders 20, 21 acting as linear drive means, which are pivotally mounted on respective opposite side of the frame 10. In the open gate position, which is shown in FIG. 1 by the solid lines, the piston-cylinders 20, 21 take a vertical position. The cylinder rods 22,23 (the extensible members of the cylinders) are pivotally connected to a first leg member 24,25 of an L-shaped force transmitting element 26,27. The free ends of the first leg members 24 and 25 are pivotally connected to sliding connectors 28,29, which are guided movably in the longitudinally extending guide members 13 and 14. The second leg members 30,31 of the L-shaped force transmitting elements 26,27 are pivotally mounted above the gate opening 15, for example on the frame 10 or an element which is fixed relative to the frame 10.

In the closing process the piston-cylinders 20,21 act on the first leg members 24,25 of the L-shaped force transmitting element 26,27, which transmits the force via the sliding connectors 28,29 to the guide members 13,14 of the rolling gate parts 11, 12, whereby the gate parts 11,12 are moved to the gate center, guided by the running carriages 18,19 travelling on the carriage tracks 16,17 above the gate opening. The force transmitting element 26,27 thus guide a pivotal motion of the second leg members 30,31 about the pivot points 32,33 and a sliding motion of the rolling gate parts 11,12 via the sliding connector 28,29 in the guide members 13,14. Simultaneously also the drive cylinders 20,21 pivot. In FIG. 1 this is clearly shown by the dashed lines of the gate in the half-open position in which the reference numbers for the guide members and the running carriages are shown primed.

Figure 2:
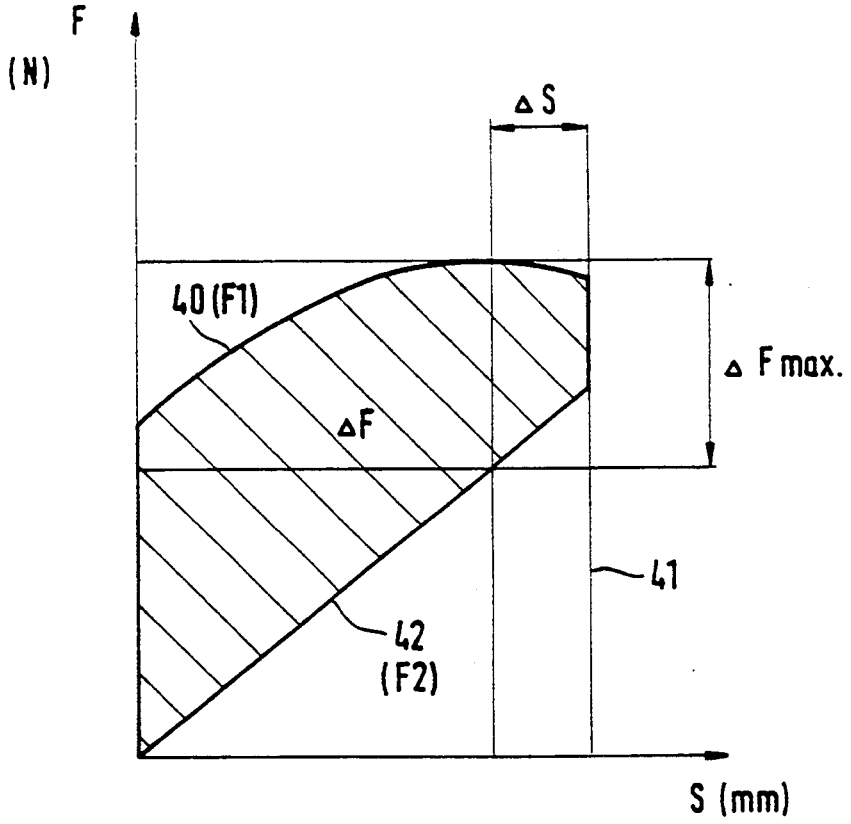
FIG. 2 is a graphical illustration of the relationship of a force on the front edge of a gate part of the gate shown in FIG. 1 versus a displacement of the gate part.

In the rolling gate with the drive mechanism shown in FIG. 1 the relationship between the force on the guide members 13 or 14 and the displacements of a gate part is shown in FIG. 2. The displacement of a gate part (in millimeters) is shown on the x-axis of the graphical illustration, while the force F in Newton is shown on the ordinate. The curve 40 shows the course of the force F1 of the drive unit of the gate part over the displacement s until the gate part is in the completely closed configuration, the closed position being shown by the line 41 in FIG. 2. The curve 42 shows the course of the increasing force F2, which opposes the drive force F1, on the winding rollers in closing the gate.

The shaded area in FIG. 2 between the curves F1 and F2 corresponds to the closing force F on the guide members 13 or 14 of the gate part. The illustration clearly shows that in a region s close to the closed position the closing force, which acts on the guide member of a gate part, again decreases. By a reduction of the closing pressure with the gate closed the danger of damage to objects inadvertently clamped or caught by the closed gate parts or part or of injury to persons caught between the closed gate parts or part is prevented. The closing force F can be kept below a maximum value $F_{max}$ predetermined by safety regulations by suitable safety mechanisms in the region s by suitable adjustment of F1 and/or F2.

Figure 3:
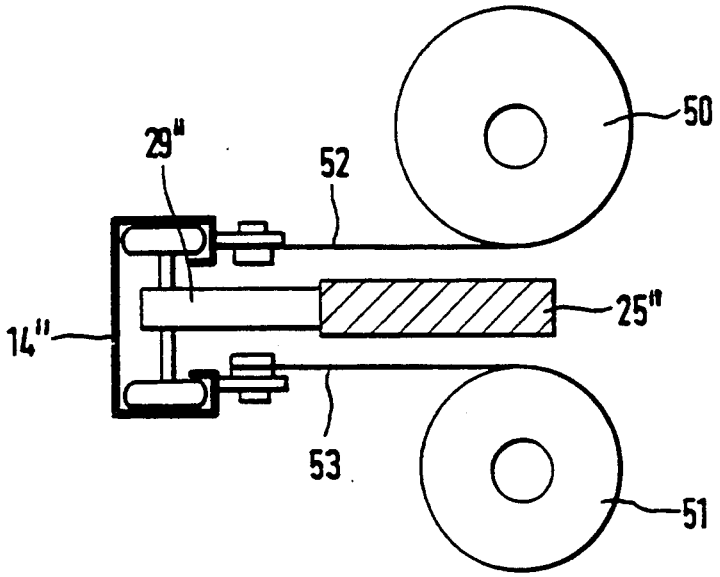
FIG. 3 is a horizontal cross-sectional view through a gate part of the gate shown in FIG. 1.

In the cross-sectional view shown in FIG. 3 a right gate part is shown in more detail in an open position. Winding roller 50 is provided for an outer cover 52 of the gate half. Similarly winding roller 51 is provided for an inner cover 53 of the gate part. The drive means of the gate part are located between both of the covers 52,53. This drive means includes a leg portion 25'' of a force transmitting element and a sliding connector 29''. The cover 53 has the purpose of protecting the drive means of the gate part to prevent damage to the gate part and also to exclude dirt from the drive mechanism. Both covers 52,53 are attached to a common guide member 14'' of the gate part. In operation of the gate part both covers 52 and 53 move together and parallel to each other.

Figure 4:
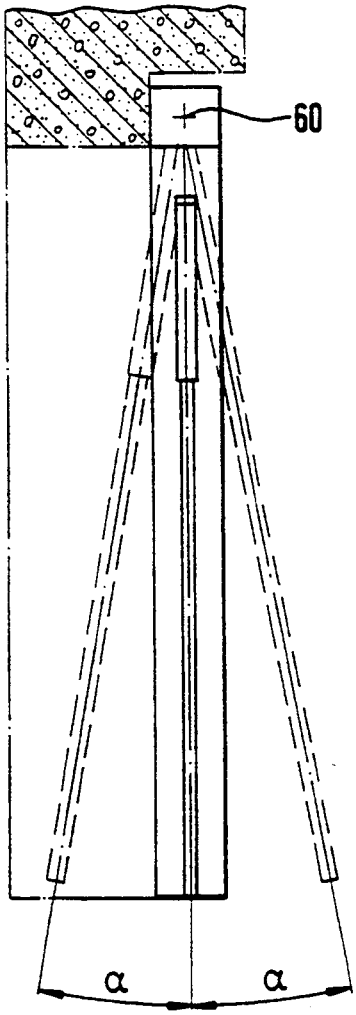
FIG. 4 is a longitudinal cross-sectional view through a gate part according to the invention.
Figure 5:
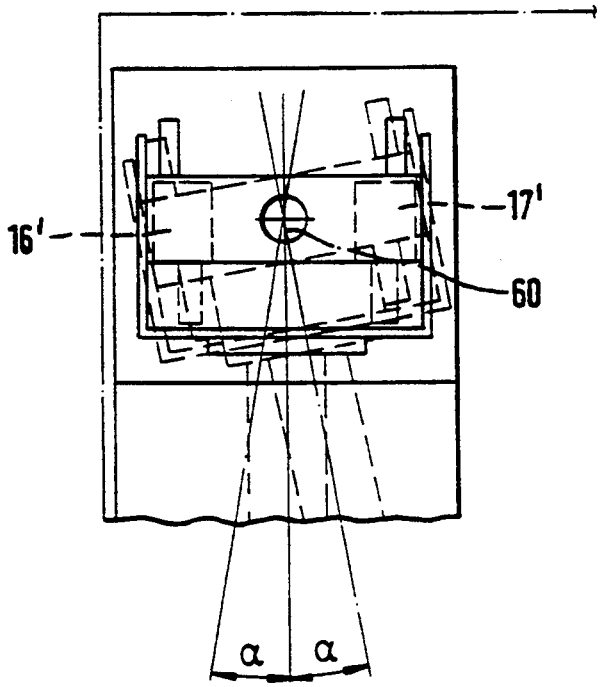
FIG. 5 is a diagrammatic detailed cutaway cross-sectional view of a portion of the device shown in FIG. 4.

In FIG. 4 and 5 the movable suspension of the carriage tracks of the rolling gate is shown. Two carriage tracks 16' and 17' shown in FIG. 5 are pivotally mounted about a common longitudinal axis 60. Thus a deformation of the suspension of the drive elements of the rolling gate can be avoided because the entire gate can pivot out an angle due to an accidental collision with a motor vehicle.

Figure 6:
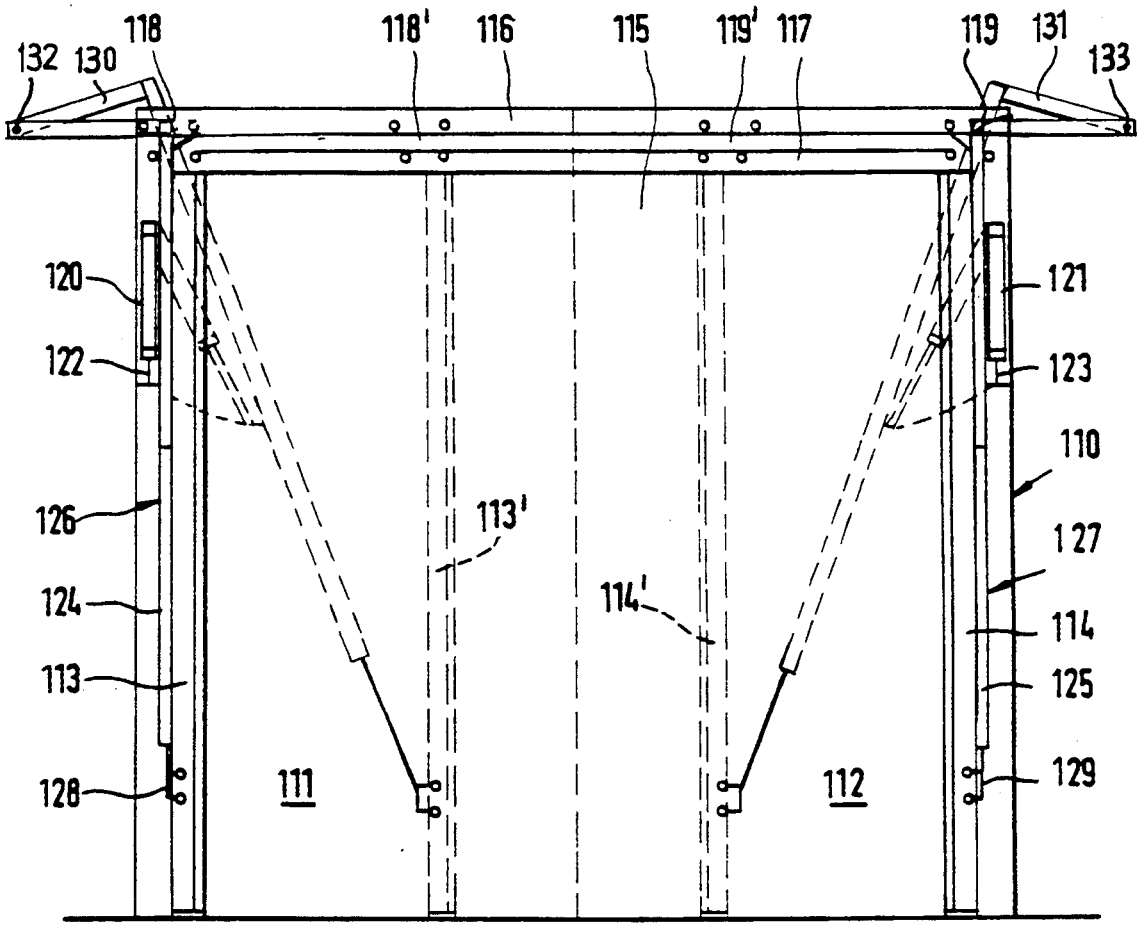
FIG. 6 is a front plan view of another embodiment of a rolling gate with two gate parts according to the invention similar to the embodiment shown in FIG. 1.

FIG. 6 shows another embodiment of the rolling gate according to the invention. This embodiment is the same as the embodiment of FIG. 1, except that the second leg members 130,131 of the L-shaped force transmitting elements 126,127 are pivotally mounted at pivot points 132,133 on a stationary member or body positioned next to or laterally of the gate opening, instead of above the gate opening. The reference numbers for parts equivalent to parts of the rolling gate shown in FIG. 1 are the same as the reference number for the corresponding part in FIG. 1 plus 100. In all respects the rolling gate of FIG. 6 operates in the same way as the rolling gate of FIG. 1 as described above.

Figure 7:
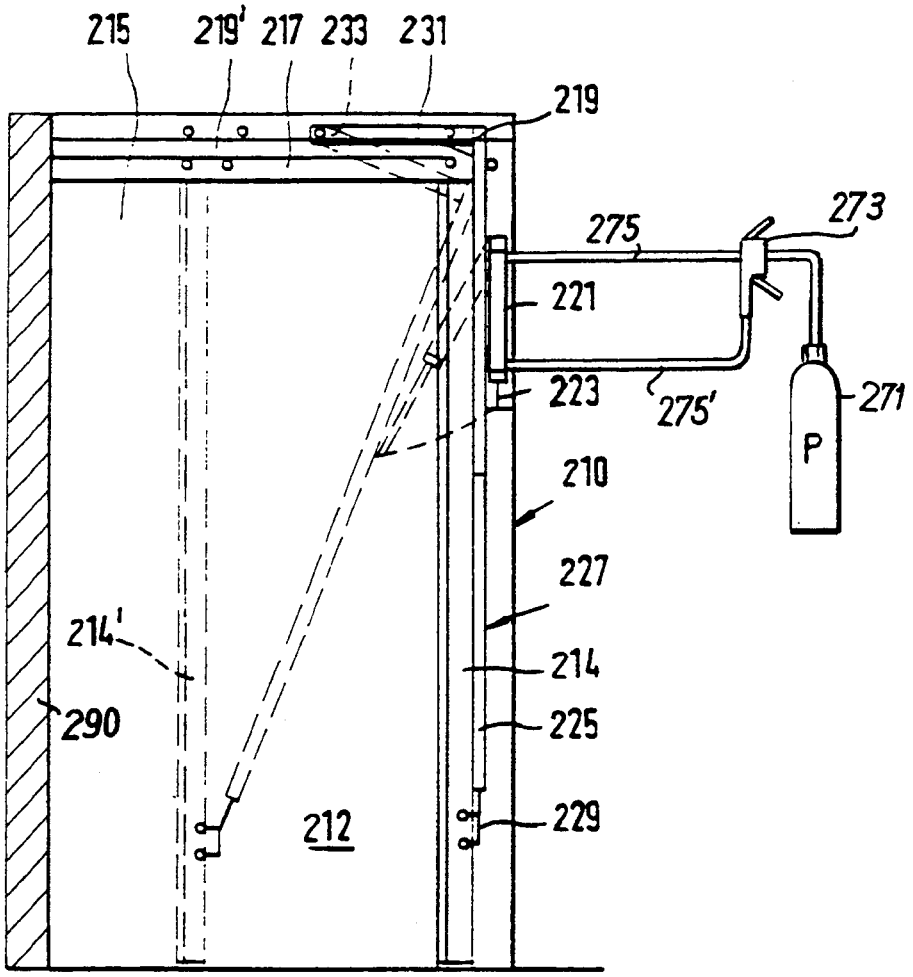
FIG. 7 is a front plan view of an additional embodiment of a gate with only one gate part or gate half according to the invention, which is otherwise similar to the embodiment of FIG. 1.

FIG. 7 shows a rolling gate having only a single gate part 212. This part is suspended and guided in the same manner as the two gate parts or halves of FIG. 1. The reference numbers for parts equivalent to parts of the rolling gate shown in FIG. 1 are the same as the reference number for the corresponding part in FIG. 1 plus 200. In all respects the rolling gate of FIG. 7 operates in the same way as the rolling gate of FIG. 1 as described above, except that only the single gate part is opened and closed.

The linear drive means can be any of a variety of piston-cylinder devices including hydraulic and pneumatic piston cylinder devices with appropriate controls and servomechanism to detect and control the application of the closing pressure of the gate parts. FIG. 7 also shows details of a linear drive means. The double pneumatic cylinder 221 can be pressurized with compressed air from tank 271 over line 275 to open the gate or over line 275' to close the gate. A three-way valve 273 is provided to pressurize the cylinder 221 over either line 275 or 275' according to choice or to bleed the air pressure.

While the invention has been illustrated and embodied in a horizontal rolling gate, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

We claim:

1. A rolling gate having a gate opening and comprising two gate parts movable toward each other from opposite sides of the gate opening and away from each other; carriage tracks mounted above the gate opening; a running carriage connected to each of said gate parts and movably mounted on said carriage tracks above the gate opening so as to carry each of said gate parts as said gate parts are moved toward each other or away from each other on said carriage tracks; a guide member extending longitudinally along a front edge of each of said gate parts; an L-shaped force transmitting element connected with each of said gate parts, a first end of said L-shaped force transmitting element being pivotally connected to and slidable along said guide member of said gate part connected with said L-shaped force transmitting element and a second end of said L-shaped force transmitting element being pivotally connected to a stationary member; and linear drive means for each of said gate parts, each of said linear drive means including an extendible driven member connected to respective ones of said L-shaped force transmitting elements to pivot said L-shaped force transmitting elements connected thereto and thus move said gate parts to open and close said gate opening and to apply a controlled closing force to said gate parts.

2. A rolling gate as defined in claim 1, wherein each of said gate parts comprises at least one winding roller and at least one flexible planar member, each of said flexible planar members being connected with one of said at least one winding rollers so as to be wound and unwound from said at least one winding roller connected thereto so as to at least partially cover said force transmitting elements and said drive means, said winding rollers for said two gate parts being positioned on opposite sides of said gate opening.

3. A rolling gate as defined in claim 2, further comprising means for adjusting a force of each of said drive means in relation to a force of said at least one winding roller opposing closing of said gate part driven by said drive means so that a net closing force acting to close said gate part, when said gate parts are a certain predetermined distance from a closed position of said gate parts, has a value below a certain predetermined maximum value.

4. A rolling gate as defined in claim 3, further comprising a slidable connector slidably mounted on each of said guide members and pivotally connected to said L-shaped force transmitting element pivotally connected to said guide member on which said slidable connector is slidably mounted.

5. A rolling gate as defined in claim 1, wherein said carriage tracks above said gate opening are pivotable through a predetermined pivot angle about a common longitudinal axis for absorbing shocks against said gate parts when said gate parts are in a closed position.

6. A rolling gate as defined in claim 1, wherein said second end of each of said L-shaped force transmitting elements is pivotally connected to said stationary member above said door opening.

7. Rolling gate as defined in claim 1, wherein said second end of each of said L-shaped force transmitting elements is pivotally connected to said stationary member laterally to said door opening.

8. A rolling gate as defined in claim 1, wherein said first end of each of said L-shaped force transmitting elements pivotally connected to said guide member is pivotally connected in a lower half of each of said guide member.

9. A rolling gate as defined in claim 1, wherein each of the force transmitting elements comprises a first leg member and a second leg member oriented at an angle relative to the first leg member and wherein a free end of said second leg member is pivotally connected to said stationary member above the gate opening.

10. A rolling gate as defined in claim 1, wherein each of said drive means is pivotally mounted laterally to the gate opening so that, when said gate parts are in a completely open position, each of said drive means is vertically oriented.

11. A rolling gate having a gate opening and comprising a gate part movable for opening and closing of the gate opening; carriage tracks mounted above the gate opening; a running carriage connected to said gate part and movably mounted on said carriage tracks above the gate opening so as to carry said gate part as said gate part moves along said carriage tracks; a guide member extending along a front edge of said gate part; an L-shaped force transmitting element for said gate part, a first end of said L-shaped force transmitting element being pivotally connected to and slidable along said guide member of said gate part and a second end of said L-shaped force transmitting element being pivotally connected to a stationary member; and linear drive means for said gate part, said linear drive means including an extendible driven member connected to said force transmitting element to pivot said force transmitting element and thus move said gate part to open and close said gate opening and to apply a controlled closing force to said gate part.

12. A rolling gate as defined in claim 11, wherein said gate part comprises at least one winding roller and at least one flexible planar member, each of said at least one flexible planar members being connected with one of said at least one winding rollers so as to be wound and unwound therefrom so as to at least partially cover said force transmitting element and said drive means.

13. A rolling gate as defined in claim 12, further comprising means for adjusting a force of said drive means in relation to a force of said at least one winding roller opposing closing of said gate part driven by said drive means so that a net closing force acting to close said gate part, when said gate part is a certain predetermined distance from a closed position, has a value below a certain predetermined maximum value.

14. A rolling gate as defined in claim 13, further comprising a slidable connector slidably mounted on said guide member and pivotally connected to said L-shaped force transmitting element.

15. A rolling gate as defined in claim 11, wherein said carriage tracks above said gate opening are pivotable through a predetermined pivot angle about a common longitudinal axis for absorbing shocks against said gate part when said gate part is in a closed position.

* * * * *